US005517833A

United States Patent [19]

Mustee et al.

[11] Patent Number: 5,517,833

[45] Date of Patent: May 21, 1996

[54] WASHING MACHINE WATER DISCHARGE HANDLING SYSTEM

[75] Inventors: Robert J. Mustee; William E. Trsek, both of Middleburg Heights, Ohio

[73] Assignee: E.L. Mustee & Sons, Inc., Cleveland, Ohio

[21] Appl. No.: 294,259

[22] Filed: Aug. 23, 1994

[51] Int. Cl.[6] ..... D06F 39/02

[52] U.S. Cl. ..... 68/17 R; 68/208; 68/902; 134/182

[58] Field of Search ..... 68/17 R, 208, 68/902; 134/182, 183; 137/802; 239/499, 505, 512, 513, 521, 522, 523, 524, 193; 141/392

[56] References Cited

U.S. PATENT DOCUMENTS

| | | | |
|---|---|---|---|
| 2,053,533 | 9/1936 | Rizor | 68/208 |
| 2,750,779 | 6/1956 | Whyte | 68/208 |
| 2,780,241 | 2/1957 | Mustee . | |
| 2,809,650 | 10/1957 | Anderson | 68/208 |
| 3,056,749 | 10/1962 | Griffith | 239/523 |
| 3,070,984 | 1/1963 | Thomas | 68/208 |
| 3,144,211 | 8/1964 | Goldman | 239/523 |
| 4,715,535 | 12/1987 | Mulder | 239/521 |
| 4,823,409 | 4/1989 | Gaffney et al. | 239/523 |
| 4,912,782 | 4/1990 | Robbins | 239/523 |
| 5,115,974 | 5/1992 | Tobias et al. | 239/193 |
| 5,249,744 | 10/1993 | Ruthenberg | 239/193 |
| 5,253,811 | 10/1993 | Seith | 239/523 |

FOREIGN PATENT DOCUMENTS

| | | | |
|---|---|---|---|
| 3632005 | 4/1988 | Germany | 239/521 |
| 673322 | 7/1979 | U.S.S.R. | 239/524 |
| WO92/06788 | 4/1992 | WIPO | 239/193 |

OTHER PUBLICATIONS

E. L. Mustee and Sons, Inc.—Duratub® 91/93—Appliance-size Laundry Cabinets advertising brochure/literature, date of publication believed to be Jan., 1993.

E. L. Mustee and Sons, Inc.—Duratub®—Completing the modern home laundry advertising brochure/literature, year of publication believed to be 1969.

*Primary Examiner*—Frankie L. Stinson

*Attorney, Agent, or Firm*—Watts, Hoffmann, Fisher & Heinke

[57] ABSTRACT

An apparatus for fluidly connecting a washing machine with a utility tub in a laundry cabinet. A fluid discharge device is attachable to a utility tub. The discharge device includes an elbow having an inlet, an outlet and a passage for conducting fluid between the inlet and outlet. A flow restrictor is located in the passage. The restrictor defines a wide flow path near a top wall of the outlet and a narrow flow path near a bottom wall of the outlet. A deflector surface is located adjacent the outlet and extends transversely relative to the extent of the outlet. The deflector surface directs fluid flow from the outlet in a direction transversely to the passage in a quiet, non-turbulent and thin flat stream of fluid into the utility cabinet.

6 Claims, 3 Drawing Sheets

WASHING MACHINE WATER DISCHARGE HANDLING SYSTEM

BACKGROUND OF THE INVENTION

1. Technical Field

The present invention relates generally to a water discharge handling system for use with a washing machine and, more particularly, to a system for conducting the discharged water to a utility tub.

2. Description of the Prior Art

U.S. Pat. No. 2,780,241 discloses a water discharge and suds saver system for connecting an automatic washing machine to a utility tub. As disclosed in the patent, a water discharge hose from the washing machine extends to a fixture in the utility tub while a second hose attached to the fixture is selectively placed directly above or away from an opening at the top of an upstanding tube connected to a drain in the utility tub. Soapy water from the washing machine can be saved for reuse by directing it away from the opening of the upstanding tube and into the tub. All rinse water and soapy water not to be saved is disposed of by directing it into the opening of the upstanding tube and into the drain. An inlet hose extends from a second fixture in the utility tub to the bottom of the tub. A hose extends from the second fixture to the washing machine to conduct the soapy water saved in the utility tub to the washing machine.

Another similar water discharge handling and suds saver system is available from E. L. Mustee and Sons, Inc. in Cleveland, Ohio under the name Handiflo®. This system performs the same discharge and suds saver functions as disclosed in U.S. Pat. No. 2,780,241 but with only a single fixture connected to the utility tub.

Recently manufactured washing machines typically do not include a suds saver feature which is necessary to the operation of the system disclosed in U.S. Pat. No. 2,780,241. For example, recently manufactured washing machines having a suds saver feature represent less than five percent of the washing machines marketed in the United States, whereas, the suds saver feature was previously included on up to forty percent of the washing machines marketed in the United States.

SUMMARY OF THE INVENTION

The discharge system of the present invention is designed for use with a washing machine that does not have a suds saver feature. The discharge system of the present invention includes a feature of discharging water into a utility tub in a relatively thin flat stream or "wall" of water.

The present invention is an apparatus for connecting a washing machine with a utility tub. The apparatus includes a discharge device which is attachable to the utility tub to direct water from the washing machine as a non-turbulent, quiet and thin flat stream into a utility tub for drainage. The discharge device comprises an elbow having an inlet and an outlet with a passage connecting the inlet and outlet. A restrictor is located in the passage and has a wide flow path near an upper wall of the passage and a narrow flow path near a lower wall of the passage. The wide flow path provides a greater flow of water along the upper wall of the passage. A deflector surface is located outside of the outlet and extends transversely to the extent of the outlet. The deflector surface directs water flow from the outlet transversely to the extent of the passage as a thin flat stream.

The apparatus also includes a connector attachable to a wall of a laundry cabinet supporting the utility tub for conducting water from the washing machine through the wall of the laundry cabinet. A hose connects the connector and the discharge device.

In a preferred embodiment, the restrictor has a substantially V-shaped configuration. The deflector surface is disposed at an obtuse angle relative to the extent of the passage near the outlet with the wide flow path located nearer to the deflector surface than the narrow flow path.

BRIEF DESCRIPTION OF THE DRAWINGS

Further features of the present invention will become apparent to those skilled in the art to which the present invention relates from reading the following specification with reference to the accompanying drawings, in which.

DESCRIPTION OF A PREFERRED EMBODIMENT

Figure 2:
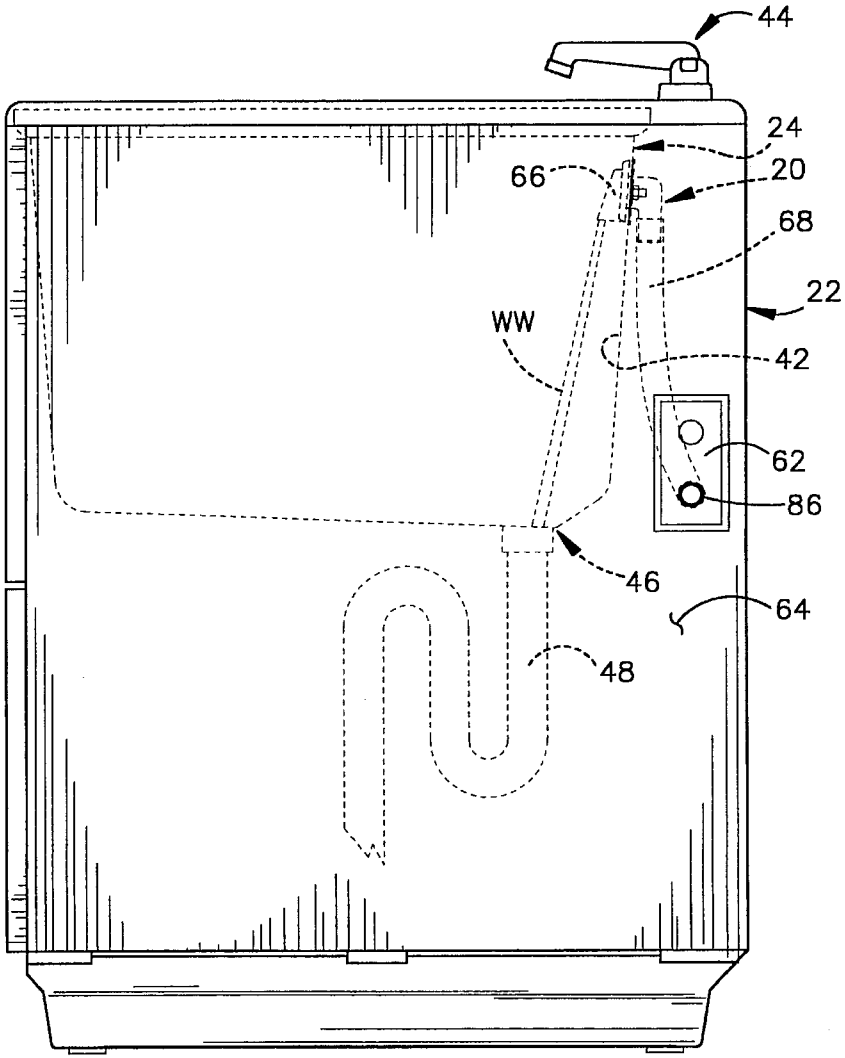
FIG. 2 is a side view of the laundry cabinet of FIG. 1, taken along line 2—2 in FIG. 1.
Figure 1:
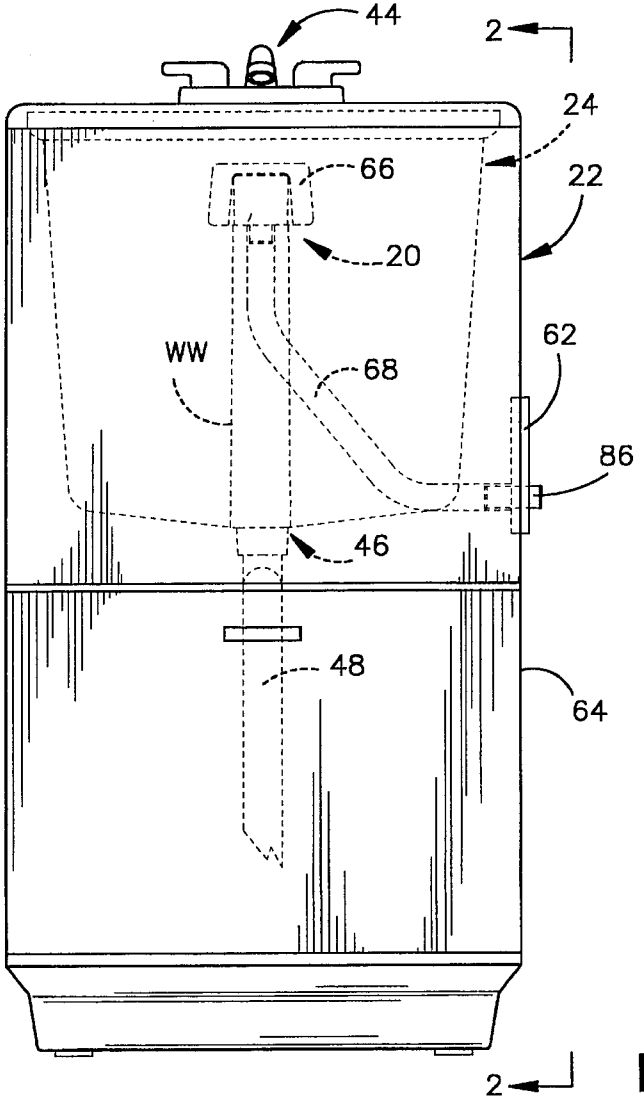
FIG. 1 is a front view of a laundry cabinet having a utility tub and a water discharge handling system embodying the present invention.
Figure 3:
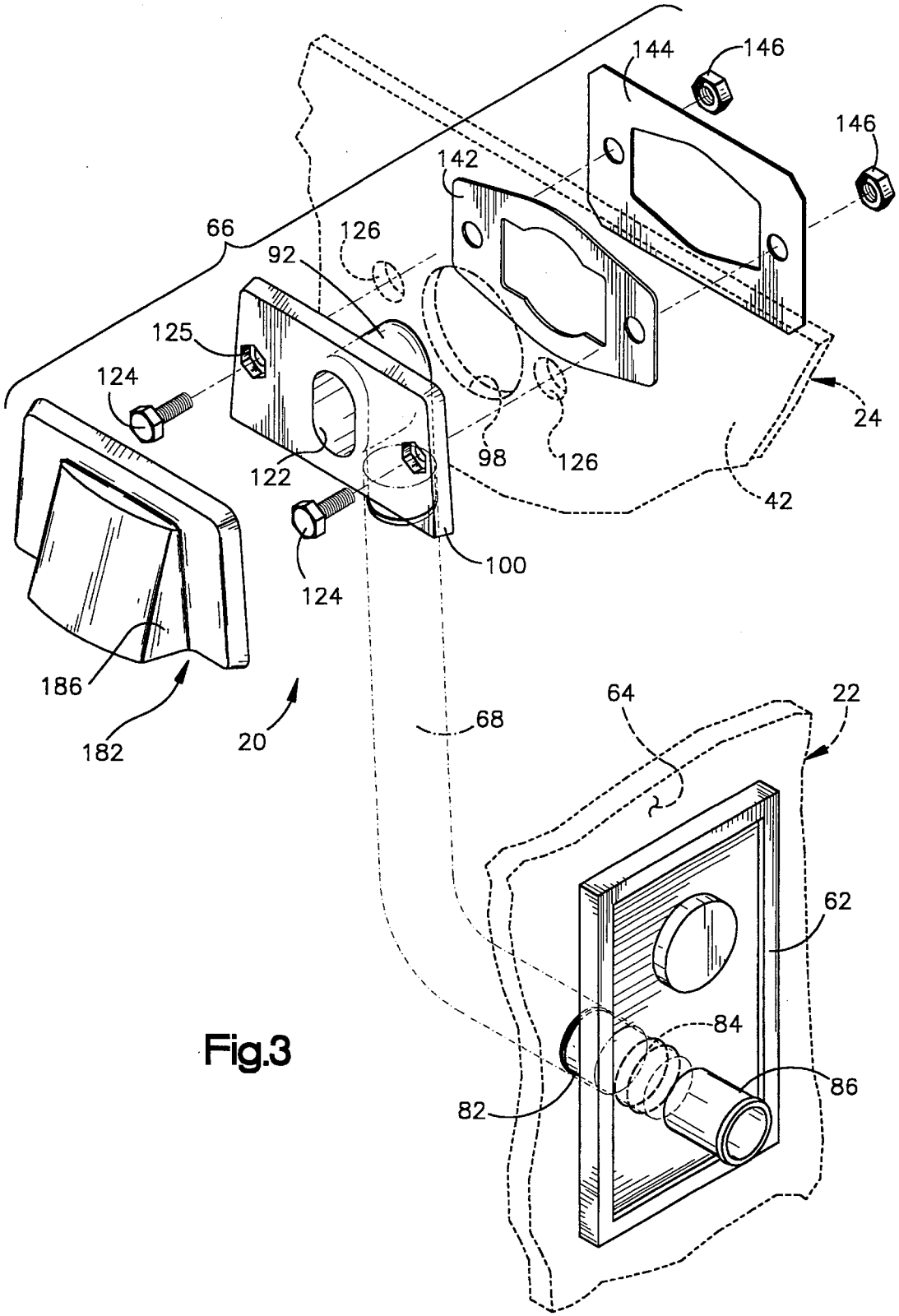
FIG. 3 is an exploded perspective view of the discharge handling system.

A water discharge handling system 20 is illustrated in FIGS. 1–3 for connecting an automatic clothes washing machine (not shown) with a utility tub 24 that is supported in a laundry cabinet 22. The water discharge handling system 20 conducts water expelled from the washing machine to the utility tub 24. As more fully explained below, the discharge handling system 20 of the present invention is constructed in a manner that moderates the otherwise turbulent discharge of water into the utility tub 24.

The utility tub 24 is defined by a bottom and four side walls including a back wall 42. The laundry cabinet 22 encloses the water containing molded fiber reinforced utility tub 24 on at least three sides. The back of the laundry cabinet 22 may be open. The laundry cabinet 22 is made from a suitable material, such as sheet metal.

A faucet 44 of a conventional design admits fresh hot or cold water, or a mixture of both, into the utility tub 24. A drain 46 in the bottom of the utility tub 24 allows water to exit the tub and to be conducted away by suitable drainage plumbing 48. While the discharge handling system 20 is described as used with a utility tub 24 supported in a laundry cabinet 22, it will be apparent that the discharge handling system can be satisfactorily employed with a stand alone utility tub.

As shown in FIG. 3, the discharge handling system 20 (FIG. 3) includes a connector 62, a water-directing discharge device 66 and a hose 68. The connector 62 is attached to an exterior surface of the side wall 64 (FIG. 2) of the laundry cabinet 22 and has an integrally molded tubular portion 82 that extends through an opening 84. The connector 62 also has a molded tubular portion 86 that is located external of a laundry cabinet 22 for attachment to a water discharge hose (not shown) from the washing machine. The tubular portions 82, 86 are in communication to conduct water through the wall 64 of the laundry cabinet 22. It will be apparent that the connector 62 can be omitted if no laundry cabinet 22 is used to support the utility tub 24 or if the washing machine discharge hose is directed through an open back side of the laundry cabinet.

The water-directing discharge device 66 is attached to the back wall 42 (FIG. 3) of the utility tub 24. The discharge device 66 includes an elbow 92 having an inlet arm 94 (FIG. 5) and an outlet arm 96. The inlet arm 94 and outlet arm 96 define a continuous passage 102 for conducting water flow. A mounting plate 100 is molded on the elbow 92 near a discharged opening 122 of the outlet arm 96.

The inlet arm 94 is placed through an opening 98 (FIG. 5) in the back wall 42 of the utility tub 24 and is oriented so the mounting plate 100 engages the back wall and the outlet arm 96 is located in the opening. Fasteners 124 have their heads located in hexagonal shaped recesses 125 and threaded portions that extend from the mounting plate 100 of the elbow 92 and through additional openings 126 in the back wall 42 of the utility tub 24. A gasket 142 and backing plate 144 are received on another side of the back wall 42 of the utility tub 24 and nuts 146 are attached to the threaded portion of the fasteners 124 to retain the discharge device 66 on the back wall of the utility tub.

The hose 68 connects the tubular portion 82 of the connector 62 located within the laundry cabinet 22 to the inlet arm 96 of the discharge device 66. The hose 68 conducts water discharged from the washing machine through the connector 62, to the discharge device 66 and then the water is directed into the utility tub 24. Once the water is located in the utility tub 24, it is directed away through the plumbing 48.

Figure 5:
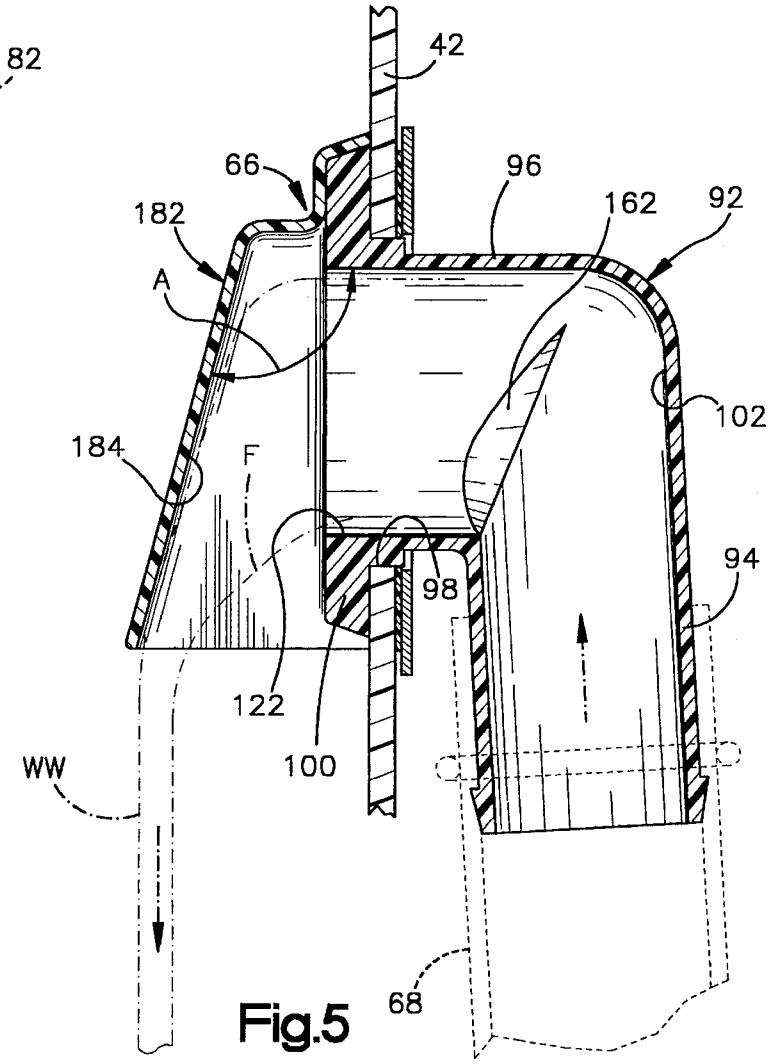
FIG. 5 is a cross-sectional view of the discharge device of FIG. 4 with a deflector cap attached, taken approximately along line 5—5 in FIG. 4.
Figure 4:
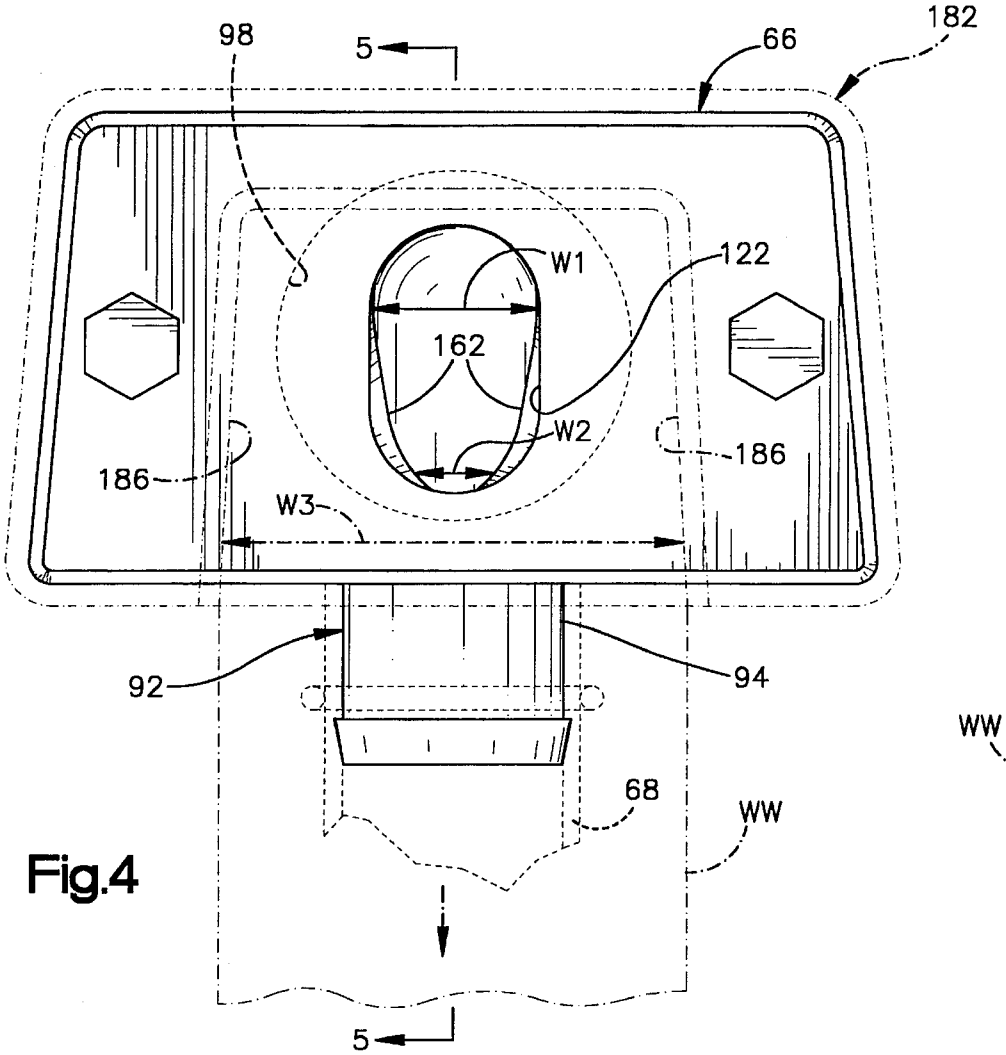
FIG. 4 is a front plan view of a discharge device of the discharge handling system with a part removed for clarity.

A restrictor 162 (FIGS. 4 and 5) is located in the passage 102 defined by the elbow 92 at the intersection of the inlet 94 and outlet 96. The restrictor 162 has a generally V-shaped configuration, as viewed in FIG. 4. The restrictor 162 provides a relatively wide flow path W1 located near an upper wall portion of the passage 102 in the outlet 96, as viewed in FIG. 4. A relatively narrow flow path W2 of the restrictor 162 is located at an opposite lower side wall portion of the passage 102. The V-shaped restrictor 162, thus, provides a greater volume flow of water along the top of the outlet 96 and at the top of the opening 122, as illustrated in FIG. 5, than at the bottom of the outlet and opening.

The discharge device 66 also includes a deflector cap 182 (FIG. 3) made of a suitable molded plastic that is attached to the mounting plate 100 of the elbow 92 by a solvent weld joint to provide a unitary assembly of the discharge device 66 for installation in the utility tub 24. The deflector cap 182 has a deflector surface 184 (FIG. 5) located outside of the opening 122 of the outlet 96. The deflector surface 184 is disposed at an obtuse angle A relative to the extent of the outlet 96 at the opening 122 so the upper portion of the deflector surface is located closest to the opening near the wide flow path W1. The relatively large volume flow of water from the top of the outlet arm 96 engages the deflector surface 184 and is directed downwardly into the utility tub 24 in a relatively thin flat stream or "wall" of water WW. This provides a relatively quiet and non-turbulent flow of water into the utility tub 24 which has been unrealizable with prior art water discharge systems.

The deflector surface 184 has an effective width W3 (FIG. 4) which is greater than the wide flow path W1. The width W3 of the deflector surface 184 is at least twice, and preferably three times the wide flow path W1. Thus, as water flow F from the opening 122 engages the deflector surface 184, the water flow is spread out laterally from the opening over the width W3 of the deflector surface and, as it is directed downwardly into the utility tub 24, forms the relatively thin flat stream of water WW having a width W3. This stream of water WW flows in a non-turbulent manner. The stream of water WW essentially flows with substantially the same width W3 downwardly for the entire distance from the deflector cap 182 to the bottom of the utility tub 24.

The deflector surface 184 is attached to the base of the deflector cap 182 by a pair of triangular side surfaces 186. The side surfaces 186 restrict the flow of water beyond the sides of the deflector surface 184 and direct the flow of water downwardly in the thin stream WW.

From the above description of a preferred embodiment of the invention, those skilled in the art will perceive improvements, changes and modifications. Such improvements, changes and modifications within the skill of the art are intended to be covered by the appended claims.

Having described at least one preferred embodiment of the invention, what is claimed is:

1. An apparatus for fluidly connecting a washing machine with a utility tub, said apparatus comprising:

a fluid discharge device attachable to a utility tub, said discharge device including:

an elbow having an inlet, an outlet and a passage for conducting fluid between the inlet and outlet;

a flow restrictor located in the passage, said restrictor defining a wide flow path near a top wall of the outlet and a narrow flow path near a bottom wall of the outlet; and a deflector surface adjacent the outlet extending transversely relative to the extent of the outlet, wherein said deflector surface directs fluid flow from the outlet in a direction transverse to the passage in a thin flat stream of fluid.

2. The apparatus in claim 1 wherein said restrictor has a substantially V-shaped configuration.

3. The apparatus in claim 1 wherein a portion of said deflector surface that is located closest to said outlet is nearer to said wide flow path than to said narrow flow path.

4. The apparatus in claim 1 wherein said inlet in said elbow extends transversely to said outlet, said restrictor being located near the intersection of said inlet and outlet.

5. The apparatus in claim 1 wherein said deflector surface has a width greater than the wide flow path.

6. The apparatus in claim 1 wherein the utility tub is supported in a laundry cabinet, further including:

a connector attachable to an exterior wall of the laundry cabinet, said connector having a first tubular member extending inside the laundry cabinet, and a second tubular member for connection with a water discharge hose of a washing machine, said second tubular member being located external of the laundry cabinet and in fluid communication with said first tubular member; and a hose for fluidly connecting said inlet of said discharge device with said first tubular member of said connector.

* * * * *